US005879103A

United States Patent [19]

Baillie

[11] Patent Number: 5,879,103

[45] Date of Patent: Mar. 9, 1999

[54] MARKERS MANUFACTURED FROM SKIS

[76] Inventor: Bob Baillie, 106 Boulder Cres., Canmore, AB, Canada, T1W1L2

[21] Appl. No.: 833,344

[22] Filed: Apr. 4, 1997

[51] Int. Cl.[6] ..... E01F 9/017

[52] U.S. Cl. ..... 404/9; 404/10; 256/1; 116/63 R; 116/63 P; 52/DIG. 9; 280/601

[58] Field of Search ..... 404/6, 9, 10, 11, 404/12; 256/1, 13.1; 116/63 R, 63 P; 40/608; 52/DIG. 9; 280/601

[56] References Cited

U.S. PATENT DOCUMENTS

| | | | |
|---|---|---|---|
| Re. 32,045 | 12/1985 | Schmanski | 404/10 |
| D. 345,656 | 4/1994 | Theobald | D6/370 |
| D. 387,916 | 12/1997 | Saban | D6/358 |
| 3,820,802 | 6/1974 | Davis | 280/11.13 T |
| 4,078,867 | 3/1978 | Ronden | 404/10 |
| 4,092,081 | 5/1978 | Schmanski | 404/10 |
| 4,249,357 | 2/1981 | Cornou | 52/728 |
| 4,939,877 | 7/1990 | Claffey | 52/155 |
| 5,028,166 | 7/1991 | Leishman | 404/10 |
| 5,360,228 | 11/1994 | Palau | 280/609 |
| 5,620,277 | 4/1997 | Cole, Sr. et al. | 404/10 |

*Primary Examiner*—James A. Lisehora

[57] ABSTRACT

The present invention relates to markers manufactured from skis. In accordance with the invention, the structure of a ski is modified to enable its use as an object which may be driven into soil or snow to designate the presence of underground objects, to delineate or identify a border or as a post for signage or fencing. The process of the invention relates to the modification of a ski by treating or removing the existing outer surfaces of a ski and providing new outer surfaces to the ski which may include graphics or notices specific to its new use. In order to inhibit the removal of a marker from soil or snow after placement, the marker may be provided with a barb system on its underground portion.

18 Claims, 5 Drawing Sheets

MARKERS MANUFACTURED FROM SKIS

FIELD OF THE INVENTION

The present invention relates to markers manufactured from skis. In accordance with the invention, the structure of a ski is modified to enable its use as an object which may be driven into soil or snow to designate the presence of underground objects, to delineate or identify a border or as a post for signage or fencing. The process of the invention relates to the modification of a ski by treating or removing the existing outer surfaces of a ski and providing new outer surfaces to the ski which may include graphics or notices specific to its new use. In order to inhibit the removal of a marker from soil or snow after placement, the marker may be provided with a barb system on its underground portion.

BACKGROUND OF THE INVENTION

The ski industry discards thousands of skis each year either as factory seconds from the manufacturing process or as old skis at the end of their useful life. Throughout North America and Europe, these discarded skis generally make their way to land fill sites creating a significant volume of waste.

With thousands of skis being discarded each year there are obviously environmental concerns with respect to such wasteful activities and, accordingly, there is a need for new and innovative uses for discarded skis in order to reduce the number of skis which ultimately end up at a land fill site. However, as a basic raw material, old or factory second skis come in a huge variety of lengths, colors, designs and shapes and previously, have not been considered useful as a raw material source for proposed consumer products.

Common amongst skis, however, is the fact that they are generally manufactured as highly durable and structurally-strong objects for their intended use as recreational items in a demanding environment. Accordingly, under the basic exterior structure of a ski is an underlying raw material of significant strength and uniformity which could be used in new products. One such use is as marker which may be used for the identification of underground cables (i.e. utility markers), as highway or railway markers, as miscellaneous use markers for delineating boundaries such as driveways or gardens or as a boundary marker at ski resorts or any open area where it is required to create or mark off specific boundaries. Another use would be in support for signage or fencing.

Hereinbefore, however, skis have not been considered for such an applications. A review of the prior art has shown utility or road markers specifically manufactured from raw materials for such purposes and are described as such in U.S. Pat. 4,249,357 (Cornou) as a synthetic-resin road marker having a specific extruded form. Examples of other utility markers include those disclosed in U.S. Pat. No. 4,078,867, which describes the specific structure of a traffic marker post specifically manufactured for such a use.

A still further example of a utility road marker is that which is described in re-issued Pat. No. 32,045 (Schmanski, re-issued Dec. 10, 1985) which also describes a flexible highway maker having a specific form.

Still further and related to ground marker systems, U.S. Pat. No. 4,939,877 (Claffey) describes an anchor device for supporting the post of signs, flags, road markers and the like.

An example of a use for factory second skis is described in U.S. Design Pat. No. 345,656 (Theobald) which describes the ornamental design of a "Adirondack" type chair in which the back of said chair is manufactured from a plurality of skis cut to different lengths.

However, the above mentioned patents do not describe the modification of a ski in order to facilitate its use as a marker.

SUMMARY OF THE INVENTION

In accordance with the invention, a marker manufactured from a ski is provided, the marker comprising:

the ski body with the tip region removed;

lower edge means on the ski body adapted for driving the marker into an earth or snow surface;

at least one re-surfaced surface on the ski body.

In further and more specific forms, the marker includes means for inhibiting removal of the marker from the earth or snow surface, the means for inhibiting removal adjacent the lower edge wherein said means is a barb system and the barb is an outwardly and upwardly projecting plate attached to the ski body.

In another embodiment, the means for inhibiting removal is an end-cap adapted for attachment to the lower edge of the ski body with the end cap including an upwardly and outwardly projecting barb wherein the end-cap is further adapted for driving the marker into an earth or snow surface. In a more specific form of the end-cap, the end-cap includes an open cavity for placement over the lower edge, the open cavity including at least one inwardly and downwardly projecting ridges adapted for securing the end-cap to the ski body. Other fastening devices such screws, bolts or glue may be utilized to fasten an end-cap to the main body of the ski. The end-cap may also be provided with a universal joint to allow flexure between the above ground and below ground sections of the marker.

In a still further embodiment, the at least one re-surfaced surface includes a dip-coated top surface, bottom surface and sidewall surfaces, laminated top and/or bottom surfaces, spray coated surfaces, thermo-formed surfaces or injection molded surfaces.

In a specific form, the invention provides a marker manufactured from a ski, the ski having a body including a tip region, a tail region, a top surface, a bottom surface and sidewall surfaces, the marker comprising:

the ski body with the tip region removed thereby defining a lower edge;

end-cap adapted for attachment to the lower edge, the end cap including an upwardly and outwardly projecting barb and an open cavity for placement over the lower edge, the open cavity including at least one inwardly and downwardly projecting ridge adapted for securing the end-cap to the ski body, the end-cap also including a lower tip adapted for driving the marker into an earth or snow surface;

dip-coated top surface, bottom surface and sidewall surfaces.

The invention also provides a process for manufacturing a marker from a ski, the ski having a body including a tip region, a tail region, a top surface, a bottom surface and sidewall surfaces the process comprising the steps of:

a) removing the tip region from the ski body to form a lower edge;

b) preparing at least one surface for re-surfacing wherein the at least one surface includes the top surface or the bottom surface;

c) applying a new surface to the at least one surface prepared in step b);

d) adapting the lower edge for driving the marker into an earth or snow surface.

In more specific forms of the process, the process may comprise a further step of including applying a graphic to the new surface.

Still further, step b) may include a mechanical or chemical process for preparing the at least one surface for re-surfacing, step c) may include dip-coating a new surface to the top surface, bottom surface and sidewall surfaces of the ski body, laminating a new surface to the top surface or bottom surface, spray coating new surfaces, thermo-forming new surfaces or forming new outer surfaces in an injection mold.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
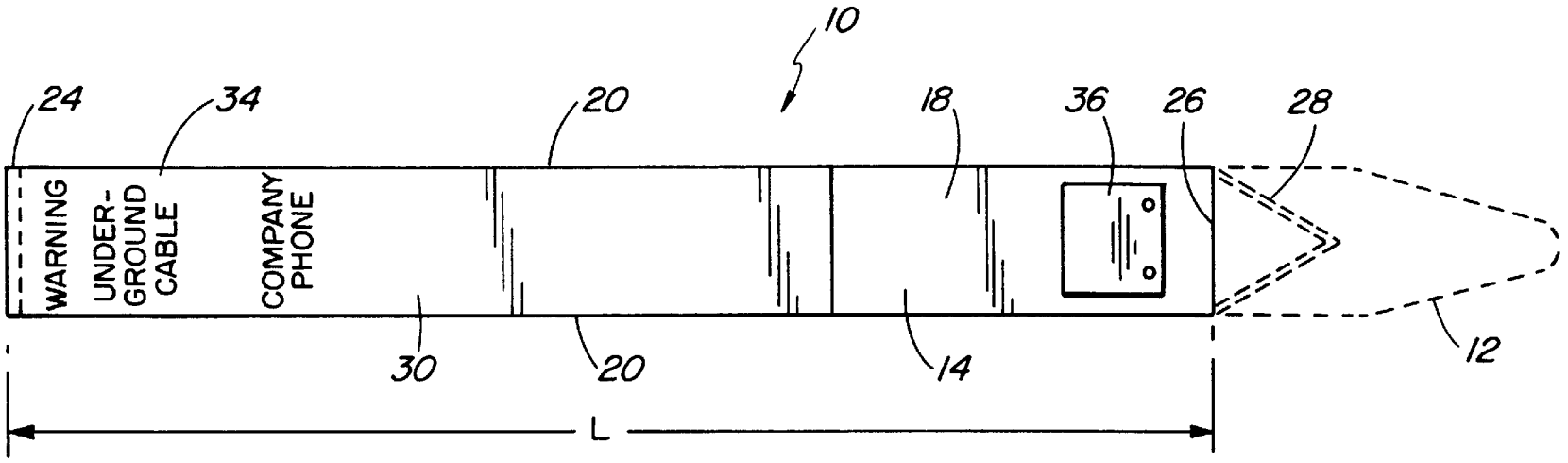
FIG. 1 is a top view of a marker manufactured from a ski in accordance with the invention.
Figure 2:
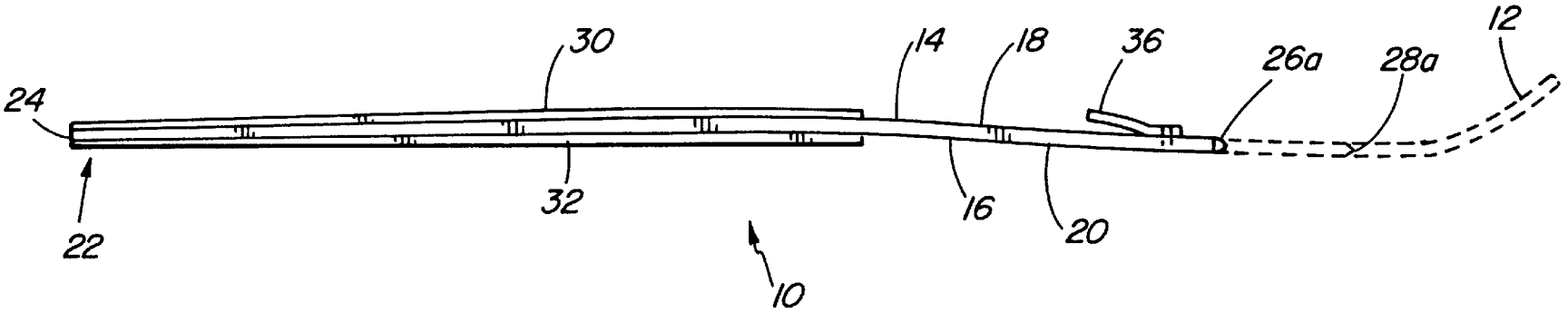
FIG. 2 is a side view of a marker manufactured from a ski in accordance with the invention.

In accordance with the invention and with reference to FIGS. 1 and 2, a marker 10 is shown. The marker 10 is manufactured from a typical ski, the tip 12 of the ski being shown in dotted outline. The main body of the ski 14 has a base surface 16 with steel edges, a top surface 18 including manufacturer's graphics and sidewalls 20. The ski has a tip 12 and a tail region 22. The tail region may include a reinforced steel section 24.

In order to modify the ski 14 in order to enable its use as a marker, the existing structure of the ski is altered in order to provide uniformity in the size and appearance of markers which may be produced. Typically, the source of old or discarded skis will include a large variety of skis having different sizes and colors. In order to manufacture a batch of similar markers from a varied or non-uniform source, initially it is desirable to roughly sort the skis on the basis of length and general physical condition.

Figure 8:
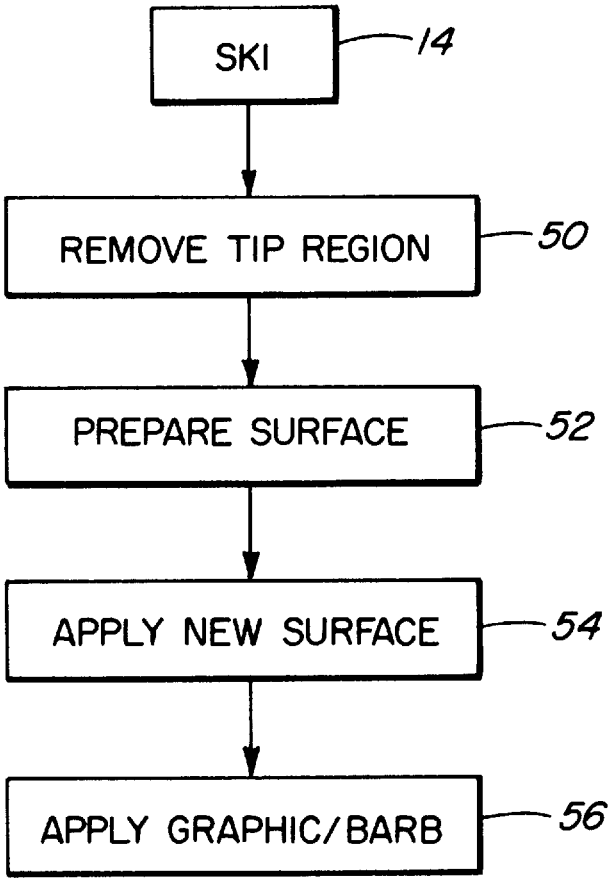
FIG. 8 is a flow diagram of the manufacturing process in accordance with the invention.

In accordance with the invention and with reference to FIGS. 1, 2 and 8, the ski tip 12 is removed from the ski 14 to form a blunt end as shown by line 26 or a pointed end as shown by double dotted line 28. In either case, the length, L, of the ski is consistent for a desired batch of markers. After removal, the ski tip 12 is discarded. A blunt end may be formed for subsequent capping with an end cap (described below) or tapered to provide a pointed edge 26*a*. Alternatively, if an end cap is not to be utilized, the ski body may be formed into a point 28 with rounded tip 28*a* to enhance driving the marker 10 into the ground as will be further described below. The tip may be removed by standard machinery such as power shears or other suitable cutting apparatus as is understood by those skilled in the art.

After removal of the tip 12, the body 14 is prepared for re-surfacing to remove any contaminants which may affect adhesion of new surfaces and/or to abrade or remove existing surfaces. This may involve complete removal of the base 16, top 18 and sidewall 20 surfaces of the ski through grinding, or preparing the base and top surfaces, through roughening or chemical treatment, to receive a new surface. Any tapering of the sidewalls of the ski may also be conducted at this time.

The preparation for re-surfacing process can be varied depending on the desired result. Grinding to remove the base and top surfaces may extend partially or completely along the length of the ski. Grinding will preferably be conducted with an automated grinding machine wherein the base, top and sidewall surfaces are ground in a single step process where opposed top and bottom and sidewall grinding drums are adjusted to remove uniform amounts of material from each surface of the ski.

Upon completion of the preparation for re-surfacing process, a new surface is applied to the base and top surfaces, and optionally, the sidewalls of the ski. In a preferred embodiment, the skis are dip coated in a liquid bath to form new outer surfaces to a desired length along the ski. The new surfaces may be applied from an appropriate molten bath of thermoplastic polymers such as vinyls, polyethylenes or polypropylenes or a solvent-based bath which may include a mixture of an organic solvent and polymer solvate. Still further, a new surface may be formed from appropriate resins, epoxies and fibres including fibreglass.

Alternative to a dip-coating process, laminates may be applied to the base and upper surfaces as shown in FIGS. 1 and 2 and designated 30, 32. A laminate may include a graphic as a component of the laminate or a graphic may be applied after the laminate is adhered to the ski. Laminates are typically thin sheets of polyethylene, polypropylene, vinyl or polyvinylchloride Any graphic which may be included is subject to the particular end-use of the marker. Preferably, the new surfaces will be visually striking colour so as to attract the attention of a viewer such as fluorescent orange or yellow. Still further, after application of a graphic, a further protective and clear coating may be applied to the marker to minimize weathering or vandalism.

Laminates may require application of an adhesive including pressure sensitive adhesives or epoxies to the ski surface by methods known to those skilled in the art including dip coating, spraying, curtain spraying or rollers. After preparing the surface for lamination, the laminate is applied and pressure is applied to the outer surfaces of the laminate by hot press, vacuum bag or roller to ensure a uniform, bubble or blister-free adhesion. Any misalignment or over-sizing of the laminate may be removed or trimmed by a grinder or other suitable method.

As indicated, the laminate may extend partially or fully along the length of the ski. As shown in FIGS. 1 and 2, the laminate 30,32 extends partially along the length of the ski. A further laminate for the remaining portion may be applied as described above or the remaining area may be left untreated. Typically, a full length laminate is preferred in order to seal the surfaces of marker. A partial length laminate may be applied to delineate between the above ground and below ground portions of the marker, to reduce the manufacturing costs of producing the marker 10 by minimizing the amount of laminate material used or in view of the particular end-use.

A still further method of applying new surfaces to the marker may include an injection molding system wherein the de-tipped ski is placed in a mold and a suitable thermoplastic is injected to surround the ski to form the new surfaces. In this embodiment, a highly uniform product may be manufactured as the outer surfaces of the marker will conform to a particular mold.

For particular applications, where it may be desired that the finished marker does not include the steel edge components of the ski, the steel edges may be ground or cut out from the ski structure. In manufacturing a marker where the steel edges of a ski have been removed, the injection molding technique described above may be particularly suitable. Similarly, the injection molding technique may be particularly desirable for cap construction skis.

In order to impede removal of a marker 10 from the ground or surface in which it has been placed, the marker is preferably provided with a barb 36 which may comprise outwardly projecting plate secured at one side of the ski 14 adjacent the edge 26. The plate may be secured to the ski 14 by any suitable means such as screws, bolts or an adhesive.

Figure 3:
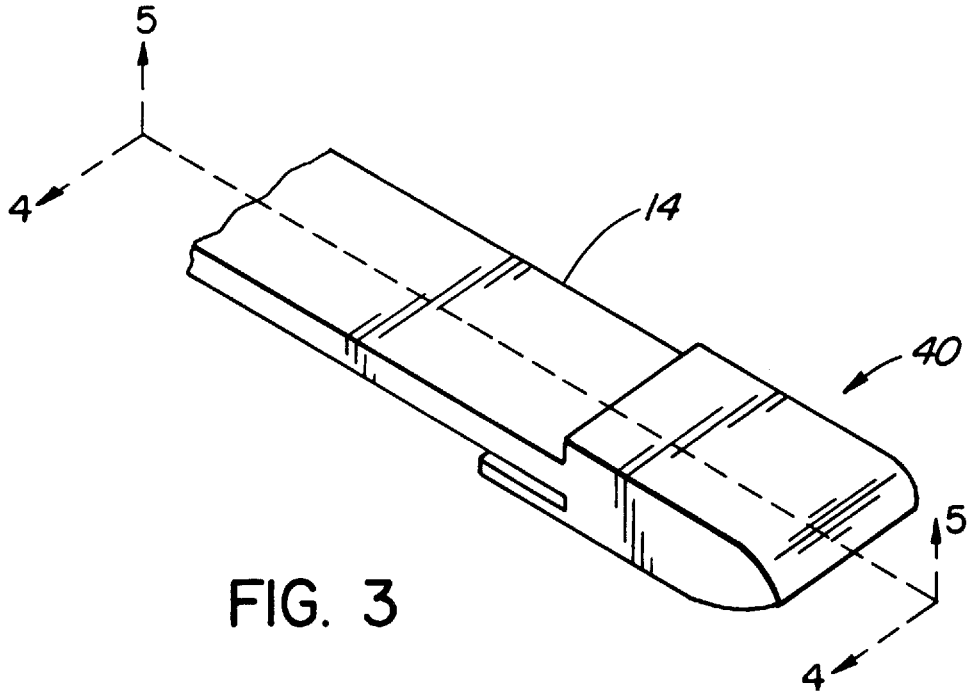
FIG. 3 is a perspective view of a marker and end-cap in accordance with the invention.
Figure 4:
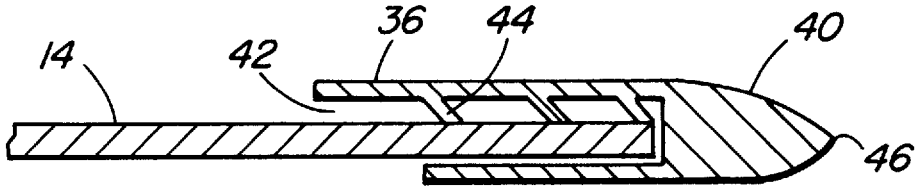
FIG. 4 is a cross-sectional view of a marker and end-cap at line 4—4 in accordance with the invention.
Figure 5:
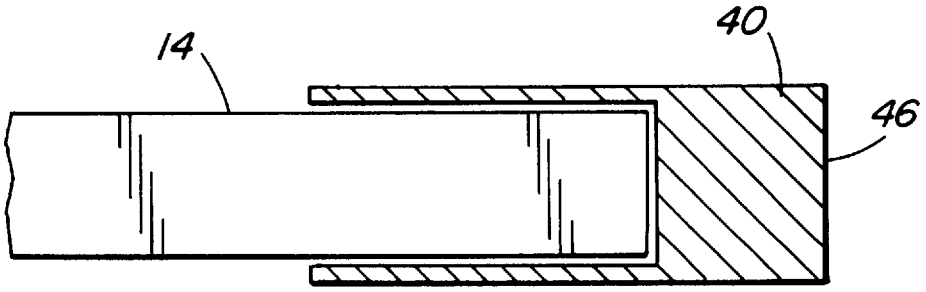
FIG. 5 is a cross-sectional view of a marker and end-cap at line 5—5 in accordance with the invention.

With reference to FIGS. 3–5, a preferred embodiment of the marker 10 and barb 36 is shown wherein an end-cap 40 is shown mounted on a ski 14. The end-cap 40 has a cavity 42 sized for placement over the end 26 of the ski and a barb 36. Within the cavity 42 and as shown in FIG. 4, the cavity 42 may include a series of inwardly projecting members 44 adapted to secure the end cap 40 to the ski 14. As shown, the inwardly projecting members may be angled towards the tip 46 of the end-cap 40 to prevent removal of the end-cap 40 from the ski 14 after insertion. The tip 46 is preferably pointed to facilitate placement of the marker 10 within the ground.

The end-cap 40 may be further secured to the ski 14 by the use of an appropriate adhesive which may also serve to seal the cut edge 26 from moisture penetration. Alternatively, an end-cap 40 may be manufactured without inwardly projecting members and instead be bolted or screwed directly onto the ski 14 after insertion.

Figure 6:
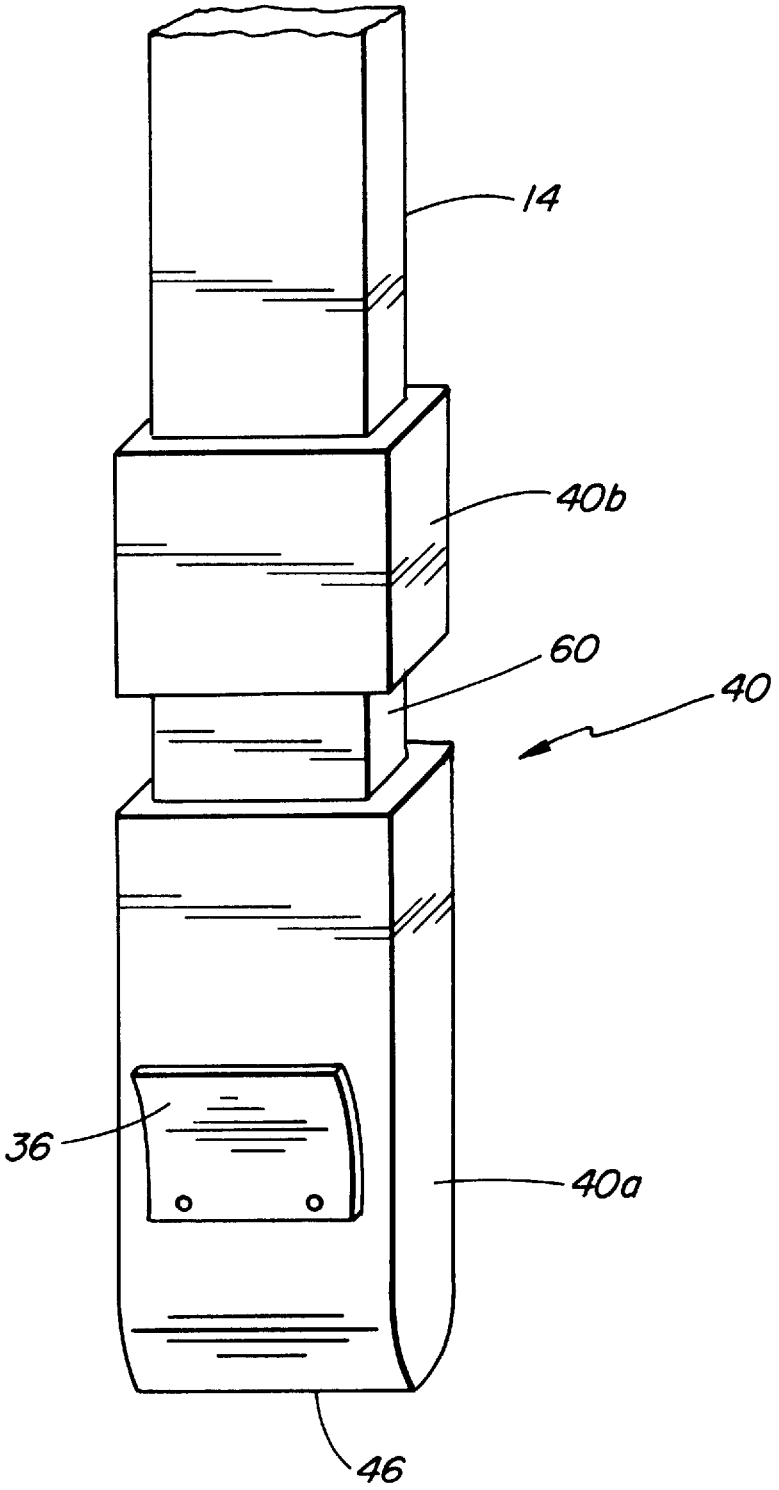
FIG. 6 is a perspective view of an alternative embodiment of an end-cap in accordance with the invention.

A further embodiment of an end-cap is shown in FIG. 6 wherein the end cap is provided with a universal joint 60 so as to permit bending of the marker at the universal joint. A marker incorporating this design of end-cap would normally be driven into the ground or snow surface so that the universal joint 60 was flush with the ground or snow surface. In this embodiment, the end-cap 40 includes a lower section 40*a* and an upper section 40*b* separated by the universal joint section 60. The universal joint 60 is preferably a resilient rubber piece having sufficient resilience to support the above ground components of the marker and sufficient flexibility so that if the above ground components of the marker are subjected to a bending force, the universal joint 60 will allow the upper section to bend without breaking the marker. The lower section 40*a* is preferably provided with a pointed lower edge 46 and barb system 36 as described above. The upper section 40*b* is preferably provided with a channel permitting insertion and securement of the ski body into the end-cap as described above. Still further, the lower section 40*a* may be provided with a circular cross-section adapted for driving the marker into a ground or snow-surface which, alternatively, may also include screw threads to facilitate screwing the lower section into a ground or snow surface.

Figure 7:
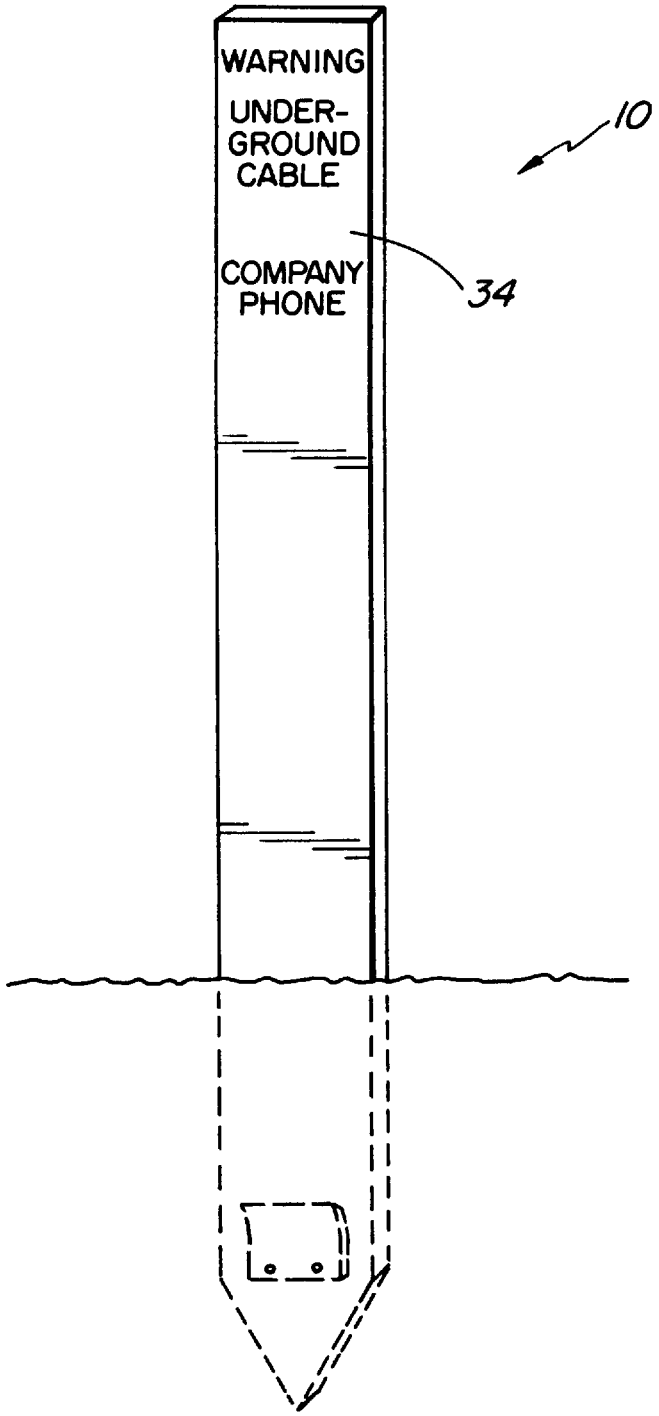
FIG. 7 is a perspective view showing an installed marker in accordance with the invention.

The marker may be placed in a surface as required by the end-user and shown in FIG. 7 For example, the marker 10 may be used to mark underground utilities such as underground wires or pipelines. In such a use, a graphic including a warning, the underground utility, the company and a phone-number may be included. Other uses may include highway markers, railway markers or trail markers bearing appropriate labels or graphics for these uses.

The marker may be driven into the ground with an appropriate driving device depending upon the particular surface. Such devices may include a regular hammer or sledgehammer or a dual-handled driving device which fits over the tail of the ski. In that the tail region of most skis include a steel end cap, the use of such driving devices, under normal circumstances will not damage, the end of the marker. Furthermore, if provided with an end-cap with threads, the marker may be screwed into the ground.

Still further, the markers may be adapted to be used as posts for signage or for fencing. In either case, the appropriate portion of the ski may be provided with a sign face or fittings to receive fence railings.

FIG. 8 summarizes the manufacturing process of the invention showing the basic steps of a) removing tip region of a ski 50, b) preparing at least one top or bottom surface of the ski for re-surfacing 52, c) applying a new surface 54, and d) applying a graphic and/or a barb to the ski, as appropriate for the particular end use 56.

It is understood that various modifications to the above description may be made as would be understood by those skilled in the art without departing from the spirit and scope of the invention.

The embodiments of the invention in which an exclusive property of privilege is claimed are defined as follows:

1. A marker manufactured from a ski, the ski having a body including a tip region, a tail region and ski surfaces including a top surface, a bottom surface and sidewall surfaces, the marker comprising:

the ski body with the tip region removed;

lower edge means on the ski body adapted for driving the marker into an earth or snow surface;

at least one re-surfaced surface on the ski body.

2. The marker as in claim 1 wherein the lower edge means includes means for inhibiting removal of the marker from the earth or snow surface.

3. The marker as in claim 2 where the means for inhibiting is a barb system wherein the barb is an outwardly and upwardly projecting plate attached to the ski body.

4. The marker as in claim 2 wherein the means for inhibiting is an end-cap adapted for attachment to the ski body, the end cap including an upwardly and outwardly projecting barb and further adapted for driving the marker into an earth or snow surface.

5. The marker as in claim 4 wherein the end-cap includes an open cavity for placement over the lower edge, the open cavity including at least one inwardly and downwardly projecting member adapted for securing the end-cap to the ski body.

6. A marker as in claim 4 wherein the end-cap includes a universal joint having sufficient resilience to support the marker and sufficient flexibility to allow flexure of the marker at the universal joint.

7. A marker as in claim 6 wherein the end-cap has a lower portion and an upper portion separated by the universal wherein the lower section has a circular cross-section.

8. A marker as in claim 7 wherein the lower section includes threads adapted for screwing the marker into a ground or snow surface.

9. The marker as in claim 1 wherein the at least one re-surfaced surface includes a dip-coated top surface, bottom surface and sidewall surfaces.

10. The marker as in claim 1 wherein the at least one re-surfaced surface includes a laminated top surface and a laminated bottom surface.

11. A marker manufactured from a ski, the ski having a body including a tip region, a tail region, a top surface, a bottom surface and sidewall surfaces, the marker comprising:

the ski body with the tip region removed thereby defining a lower edge;

end-cap adapted for attachment to the ski body, the end cap including an upwardly and outwardly projecting barb and an open cavity for placement over an end of the ski body, the open cavity including at least one inwardly and downwardly projecting member adapted for securing the end-cap to the ski body, the end-cap including a lower tip adapted for driving the marker into an earth or snow surface;

dip-coated top surface, bottom surface and sidewall surfaces.

12. A process for manufacturing a marker from a ski, the ski having a body including a tip region, a tail region, a top surface, a bottom surface and sidewall surfaces the process comprising the steps of:

a) removing the tip region from the ski body to form a lower edge;

b) preparing at least one surface for re-surfacing wherein the at least one surface includes the top surface or the bottom surface;

c) applying a new surface to the at least one surface prepared in step b);

d) adapting the lower edge for driving the marker into an earth or snow surface.

13. A process as in claim 12 further comprising applying a graphic to the new surface.

14. A process as in claim 12 wherein step b) includes a mechanical or chemical process for preparing the at least one surface for re-surfacing.

15. A process as in claim 12 wherein step c) includes dip-coating a new surface to the top surface, bottom surface and sidewall surfaces of the ski body.

16. A process as in claim 12 wherein step c) includes laminating a new surface to the top surface or bottom surface.

17. A process as in claim 12 wherein step c) includes molding new surfaces to the ski body in an injection mold.

18. A process as in claim 12 wherein step d) includes attaching an end-cap to the skibody.

* * * * *